US011440778B2

(12) United States Patent
Oshima et al.

(10) Patent No.: US 11,440,778 B2
(45) Date of Patent: Sep. 13, 2022

(54) CRANE

(71) Applicant: TADANO LTD., Kagawa (JP)

(72) Inventors: Masanori Oshima, Kagawa (JP); Hiroto Ota, Kagawa (JP); Yoshikado Itasaka, Kagawa (JP); Shota Roppongi, Kagawa (JP)

(73) Assignee: TADANO LTD., Kagawa (JP)

( * ) Notice: Subject to any disclaimer, the term of this patent is extended or adjusted under 35 U.S.C. 154(b) by 0 days.

(21) Appl. No.: 17/264,693

(22) PCT Filed: Aug. 1, 2019

(86) PCT No.: PCT/JP2019/030219
§ 371 (c)(1),
(2) Date: Jan. 29, 2021

(87) PCT Pub. No.: WO2020/031842
PCT Pub. Date: Feb. 13, 2020

(65) Prior Publication Data

US 2021/0300734 A1 Sep. 30, 2021

(30) Foreign Application Priority Data

Aug. 6, 2018 (JP) ..... JP2018-147697

(51) Int. Cl.
*B66C 23/76* (2006.01)

(52) U.S. Cl.
CPC ..... *B66C 23/76* (2013.01)

(58) Field of Classification Search
CPC ..... B66C 23/72–76
See application file for complete search history.

(56) References Cited

U.S. PATENT DOCUMENTS 3,822,791 A * 7/1974 Eiler ..... B66C 23/36 212/178
5,524,777 A * 6/1996 Weber ..... B66C 23/74 212/178
10,870,561 B2 12/2020 Bitz et al.

FOREIGN PATENT DOCUMENTS

EP 1840076 A1 * 10/2007 ..... B66C 23/72
JP 2015-040109 A 3/2015
(Continued)

OTHER PUBLICATIONS

Nov. 5, 2019, International Search Report issued for related PCT Application No. PCT/JP2019/030219.
(Continued)

*Primary Examiner* — Sang K Kim
*Assistant Examiner* — Nathaniel L Adams
(74) *Attorney, Agent, or Firm* — Paratus Law Group, PLLC

(57) ABSTRACT

Provided is a crane capable of changing a moment on a counterweight side without changing a total weight of the crane by using a simple method. The crane includes a base, and a swiveling body that is provided above the base so as to swivel about a pivot center, and includes a boom and a counterweight attaching unit. The counterweight attaching unit includes a plurality of attaching positions, and is configured to selectively attach and detach the counterweight to and from any attaching position among the plurality of attaching positions, and the plurality of attaching positions is positions of which distances from the pivot center are different from each other.

7 Claims, 9 Drawing Sheets

(56) References Cited

FOREIGN PATENT DOCUMENTS

| | | | |
|---|---|---|---|
| JP | 2015-074555 | A | 4/2015 |
| JP | 2016-088752 | A | 5/2016 |
| JP | 2017-024860 | A | 2/2017 |

OTHER PUBLICATIONS

Nov. 5, 2019, International Search Opinion issued for related PCT Application No. PCT/JP2019/030219.

* cited by examiner 16, 90, 91, 92 } 9

16A, 16B, 16C } 16

11, 12, 13, 14 } 10

12A, 12B, 12C, 12D } 12

13A, 13B } 13

14A, 14B } 14

CRANE

CROSS REFERENCE TO PRIOR APPLICATION

This application is a National Stage Patent Application of PCT International Patent Application No. PCT/JP2019/030219 (filed on Aug. 1, 2019) under 35 U.S.C. § 371, which claims priority to Japanese Patent Application No. 2018-147697 (filed on Aug. 6, 2018), which are all hereby incorporated by reference in their entirety.

TECHNICAL FIELD

The present invention relates to a crane.

BACKGROUND ART

In the related art, a structure in which the counterweight and the swiveling body are connected by using a telescopic cylinder is known as a structure of a crane for attaching and detaching a counterweight to a swiveling body on which a boom is able to be hoisted (for example, Patent Literature 1).

According to the structure disclosed in Patent Literature 1, a lower end portion of the telescopic cylinder is attached to the counterweight. When the counterweight is attached to the swiveling body, the telescopic cylinder is extended, and thus, an upper end portion of the telescopic cylinder is raised to a connection bracket of the swiveling body. When the upper end portion of the telescopic cylinder reaches a position of the connection bracket, the cylinder and the connection bracket are connected. The telescopic cylinder is contracted, and the counterweight is pulled up to the connection bracket of the swiveling body.

CITATION LIST

Patent Literature

Patent Literature 1: JP 2015-40109 A

SUMMARY OF THE INVENTION

Problems to be Solved by the Invention

According to the structure disclosed in Patent Literature 1, when a moment of a load on a front side becomes large, it is necessary to increase a moment on the counterweight side which is suspended from the load on the front side according to the increased moment. In Patent Literature 1, the moment is increased by increasing a weight of the counterweight, but a total weight of a vehicle body is simultaneously increased.

An object of the present invention is to provide a crane capable of changing a moment on a counterweight side without changing a total weight of the crane by using a simple method.

Solutions to Problems

An aspect of a crane according to the present invention includes a base, and a swiveling body that is provided above the base so as to swivel about a pivot center, and includes a boom and a counterweight attaching unit. The counterweight attaching unit includes a plurality of attaching positions, and is configured to selectively attach and detach a counterweight to and from any attaching position among the plurality of attaching positions, and the plurality of attaching positions is positions of which distances from the pivot center are different from each other.

Effects of the Invention

According to the present invention, it is possible to change a moment on a counterweight side without changing a total weight of a crane by using a simple method.

DESCRIPTION OF EMBODIMENTS (Overall Structure)

Figure 1:
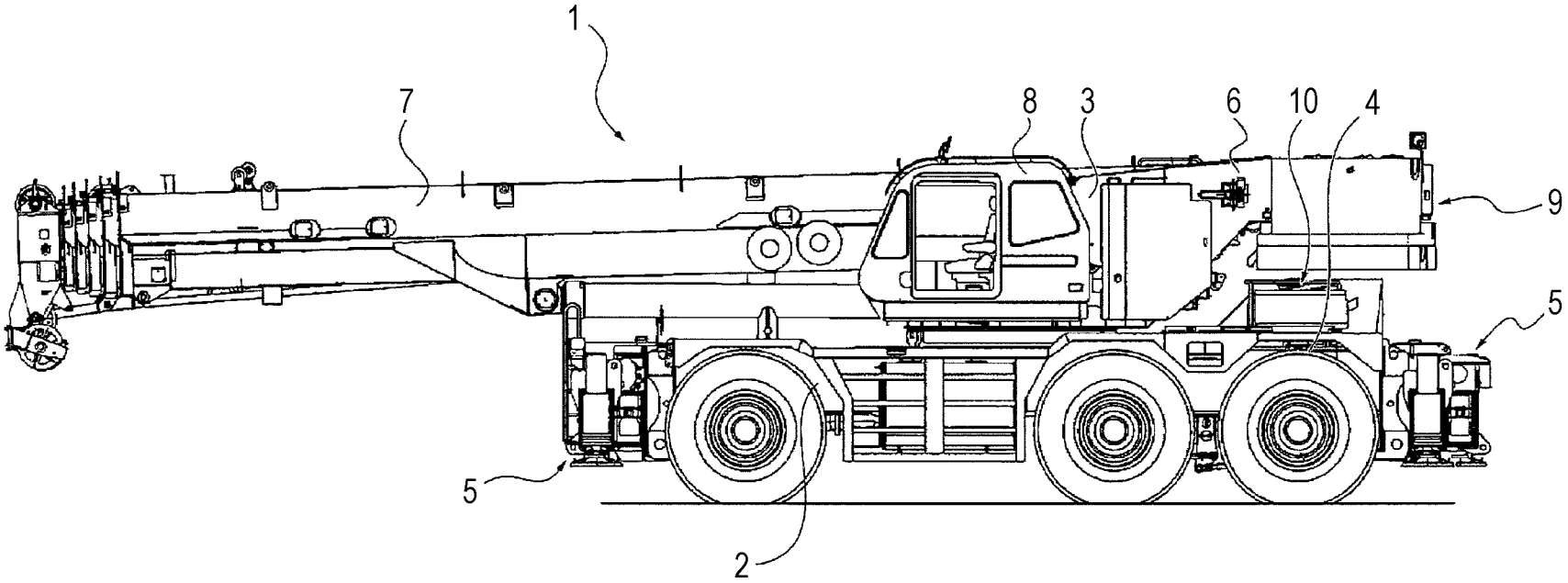
FIG. 1 is a side view showing a crane.

FIG. 1 is a side view showing a crane 1 according to an embodiment of the present invention. As shown in FIG. 1, the crane 1 includes a running vehicle 2 and a crane device 3.

(Configuration of Vehicle)

The vehicle 2 has a pair of left and right wheels at a plurality of locations at front and rear portions, and runs with an engine as a power source.

The vehicle 2 has a carrier frame 4 extending in a front-rear direction of the vehicle 2 and outriggers 5 provided on both front and rear sides of the vehicle 2. The vehicle 2 is an example of a base.

The outriggers 5 are provided at a front end portion and a rear end portion of the carrier frame 4, and a swiveling body 6 is provided on an upper surface of a substantially central portion in the front-rear direction so as to be able to swivel in a horizontal direction.

(Configuration of Crane Device)

The crane device 3 includes the swiveling body 6 provided at the substantially central portion in the front-rear direction of the vehicle 2, a boom 7 that is attached to be able to be hoisted with respect to the swiveling body 6 and is provided so as to be extendable, and a counterweight attaching structure 10 (FIG. 4) for attaching a counterweight 9 on the swiveling body 6.

The swiveling body 6 is provided so as to be able to swivel with respect to the carrier frame 4 with a predetermined pivot center (FIGS. 3A and 3B) as a center by a ball bearing type or roller bearing type swiveling circle disposed between the carrier frame 4 and the swiveling body 6. Cylinder connection units 60 and 61 (FIG. 3A) for connecting piston rods 16B (FIG. 2) to be described later are provided at the swiveling body 6.

The boom 7 is a telescope type in which adjacent boom members can be housed to a tip side inside a plurality of boom members.

The crane device 3 further includes a work cabin 8 provided at the swiveling body 6 and performing a running operation of the vehicle 2 and a work operation of the crane device 3, and the counterweight 9 provided at a rear portion of the swiveling body 6 so as to be attachably and detachably provided.

The counterweight 9 is attached to the rear part of the swiveling body 6 in order to ensure the stability of the crane 1 when a load is suspended from a tip of the boom 7.

(Configuration of Counterweight 9)

Figure 2:
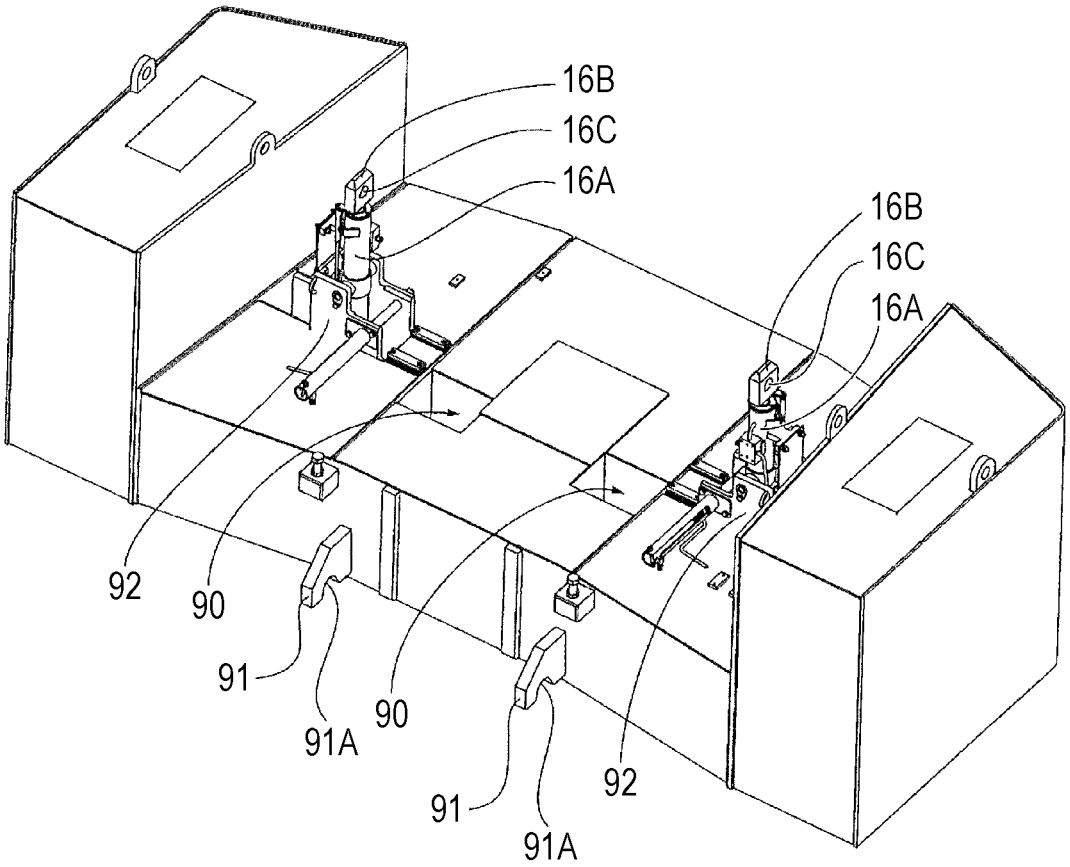
FIG. 2 is a perspective view showing a counterweight.

FIG. 2 is a perspective view showing the counterweight 9. As shown in FIG. 2, telescopic cylinders 16 (cylinder devices) are attached to the counterweight 9. The counterweight 9 is selectively positioned at two different attaching positions P1 and P2 (FIG. 4). One (P1) of the two attaching positions is a position facing a position of the cylinder connection unit 60 (to be described later) when the boom 7 is in a forward facing state, and is a attaching position at which a rear end of the swiveling body 6 (FIG. 3A) swivels to the minimum. One (P2) of the two attaching positions is a position facing the position of the cylinder connection unit 61 (to be described later) when the boom 7 is in the forward facing state, and is a attaching position at which a maximum moment is obtained. In the description of the present embodiment, it is assumed that the boom 7 is in the forward facing state unless otherwise specified.

A pair of telescopic cylinders 16 are provided side by side at a predetermined interval in a width direction, and extend and contract in a vertical direction.

Upper end sides of the telescopic cylinders 16 can be connected to the cylinder connection units 60 and 61 (FIG. 3A) to be described later.

The telescopic cylinder 16 is a hydraulic cylinder having a tube 16A and the piston rod 16B capable of advancing and retreating upward from the tube 16A. A pair of cylinder support portions 92 for supporting lower end sides of the telescopic cylinders 16 are provided side by side at the counterweight 9 at a predetermined interval in the width direction.

The telescopic cylinder 16 can connect a hydraulic hose (not shown) to a port (not shown) provided in the tube 16A.

A rod hole portion 16C opened in the width direction of the counterweight 9 is formed in an upper end portion of the piston rod 16B.

A pair of spaces 90 are provided at the counterweight 9 side by side at a predetermined interval in the width direction. When the counterweight 9 is positioned at a first attaching position P1 by weight guides 13 (FIG. 4), weight guides 14 (FIG. 4) are inserted into the spaces 90.

A pair of locking portions 91 are provided at the counterweight 9 side by side at a predetermined interval in the width direction. Recesses 91A capable of being locked into guide pins 13B and 14B (FIG. 4) are formed in the locking portions 91.

(Configuration of Cylinder Connection Units 60 and 61)

Figure 3A:
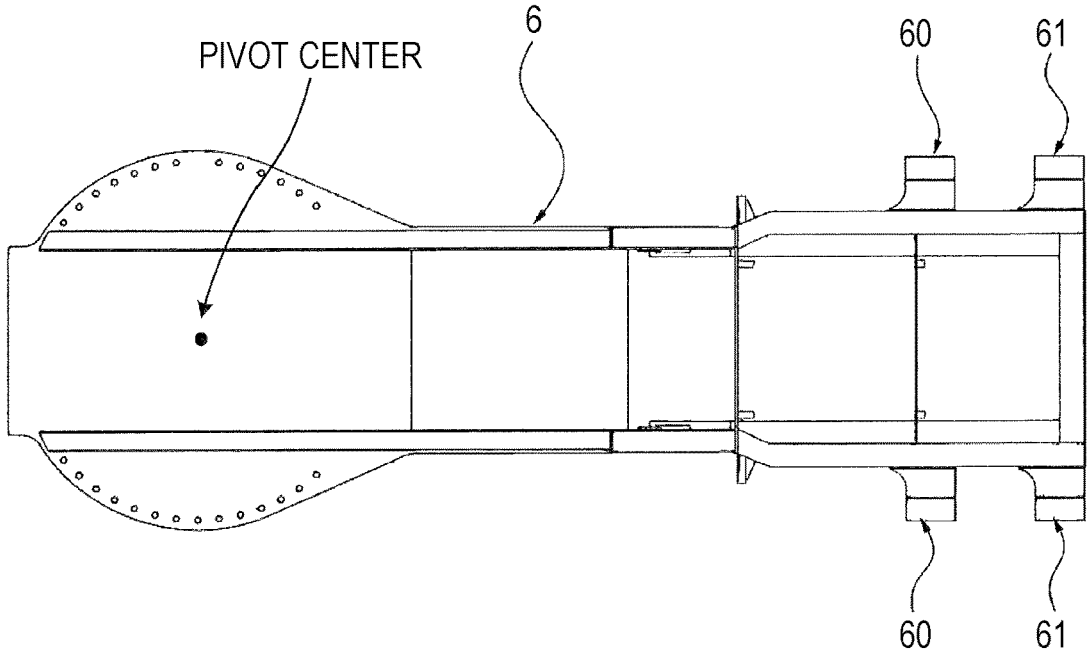
FIG. 3A is a plan view showing a swiveling body.
Figure 3B:
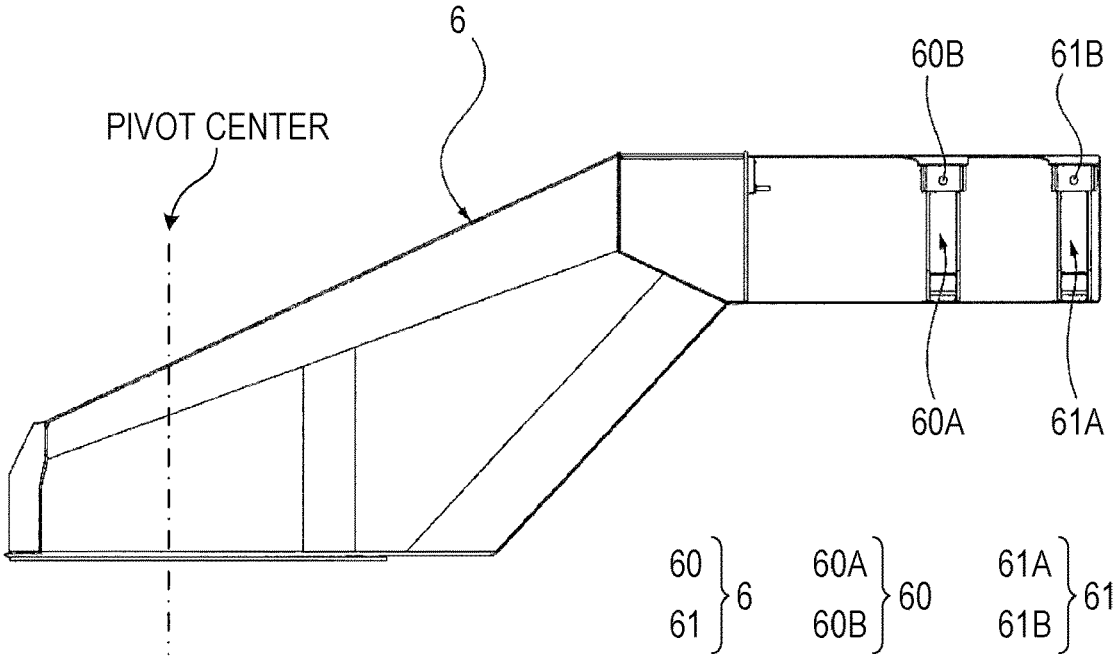
FIG. 3B is a side view showing the swiveling body.
Figure 4:
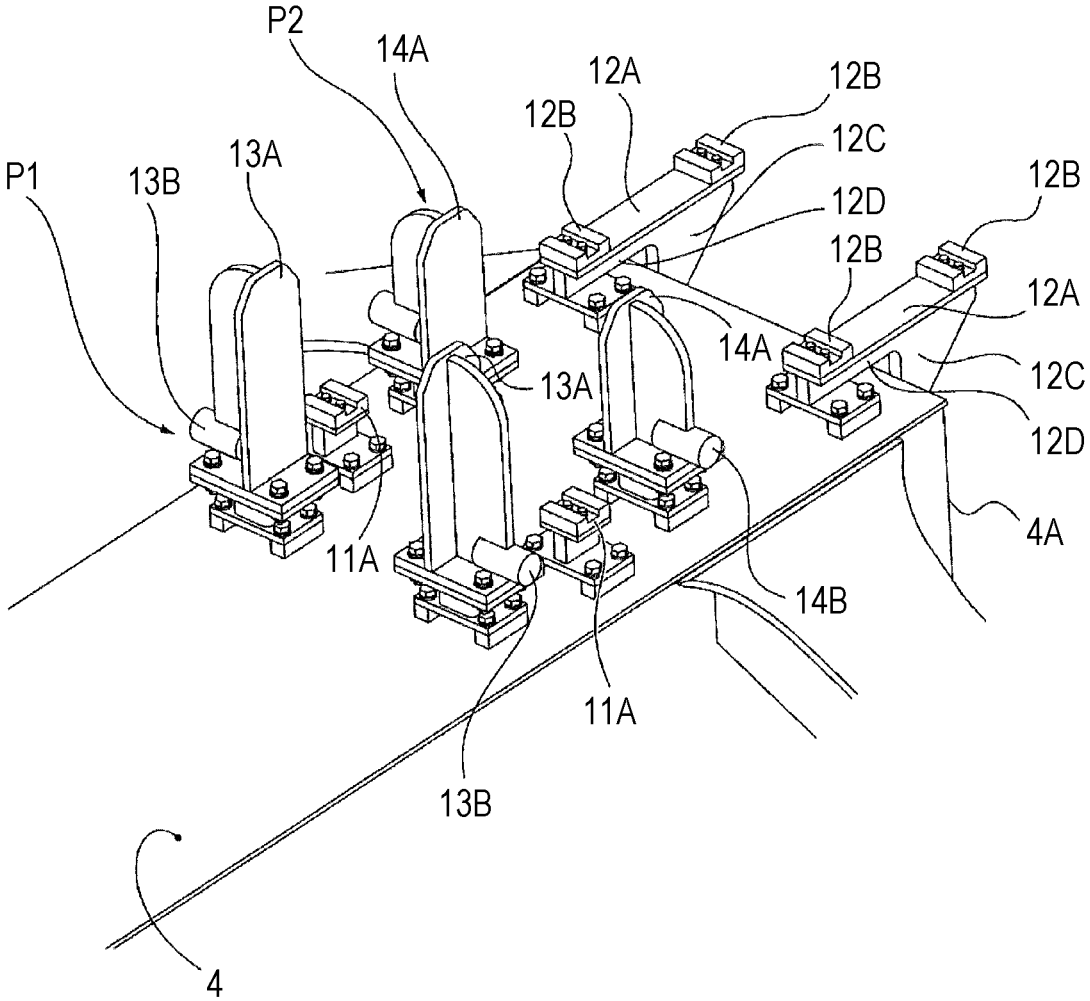
FIG. 4 is a perspective view showing a counterweight attaching structure for attaching the counterweight on the swiveling body.

FIG. 3A is a plan view showing the swiveling body 6. FIG. 3B is a side view showing the swiveling body 6. The cylinder connection units 60 and 61 for supporting the counterweight 9 at at least two different positions are provided at a plurality of locations of the swiveling body 6 on left and right side surfaces of the swiveling body 6. A part of the swiveling body 6 including the combination of the cylinder connection units 60 and 61 is an example of a counterweight attaching unit, and the positions of the individual cylinder connection units 60 and 61 are examples of attaching positions of the counterweight attaching unit. The cylinder connection unit 61 is provided at the rearmost end of the swiveling body 6. This position is a position at which a distance from the pivot center is the longest in the front-rear direction of the swiveling body 6, and thus, a moment on the counterweight 9 side can be a maximum value. The cylinder connection unit 60 is provided at a position at which the counterweight 9 can be supported so as to be closest to the pivot center in the front-rear direction of the swiveling body 6. This position is a position at which a swiveling range of the swiveling body 6 at which the counterweight 9 is installed is the smallest and a space-saving work can be performed. The front-rear direction of the swiveling body 6 is a direction in which the boom 7 extends with respect to the pivot center of the swiveling body 6 (forward direction) and an opposite direction, that is, a direction in which the counterweight attaching unit extends with respect to the pivot center of the swiveling body 6 (rearward direction) when the swiveling body 6 is viewed in plan view. When the boom 7 is in the forward facing state, the front-rear direction of the swiveling body 6 coincides with the front-rear direction of the vehicle 2 in the plan view of the swiveling body 6. As shown in FIG. 3B, the cylinder connection unit 60 has a rod passage 60A, a swiveling body connection hole portion 60B, and a connection pin (not shown) provided at the rear portion of the swiveling body 6.

As shown in FIGS. 3A and 3B, the cylinder connection unit 61 has the same structure as the cylinder connection unit 60, and is provided on a rear side of the cylinder connection unit 60. That is, the cylinder connection unit 61 includes a rod passage 61A, a swiveling body connection hole portion 61B, and a connection pin (not shown) provided at the rear portion of the swiveling body 6.

As shown in FIG. 3B, the rod passages 60A and 61A extend in the vertical direction, lower ends are opened, and are closed by ceiling plates. When the counterweight 9 (FIG. 2) is positioned at the first attaching position P1 (FIG. 4), the piston rod 16B (FIG. 2) is disposed directly below the rod passage 60A. Accordingly, the piston rod 16B is set to be inserted into the rod passage 60A.

On the other hand, when the counterweight 9 (FIG. 2) is positioned at a second attaching position P2 (FIG. 4), the piston rod 16B (FIG. 2) is disposed at a position facing the rod passage 61A, that is, directly below the rod passage 61A. Accordingly, the piston rod 16B is set to be inserted into the rod passage 61A.

The upper end portions of the piston rod 16B (FIG. 2) can come in contact with the ceiling plates of the rod passages 60A and 61A.

The swiveling body connection hole portions 60B and 61B penetrate the rod passages 60A and 61A in the width direction of the swiveling body 6, respectively.

The connection pin can be inserted into the rod hole portion 16C (FIG. 2) and any of the swiveling body connection hole portions 60B and 61B.

(Configuration of Counterweight Mounting Structure 10)

FIG. 4 is a perspective view showing the counterweight attaching structure 10. As shown in FIG. 4, the counterweight attaching structure 10 includes weight support portions 11 and 12 and the weight guides 13 and 14 provided on the carrier frame 4. The weight guides 13 and 14 are examples of a plurality of positioning members included in a positioning unit.

The weight support portions 11 and 12 are a pair of members provided on both sides of an upper surface of a rear portion of the carrier frame 4 in the width direction, and are attaching tables on which the counterweight 9 (FIG. 2) is attached.

The weight support portion 11 has a support portion 11A that supports a lower surface of the counterweight 9.

The weight support portion 12 includes a rectangular pedestal 12A extending in the front-rear direction, and support portions 12B provided at front-rear ends of the pedestal 12A and supporting the lower surface of the counterweight 9.

The pedestal 12A is held by an inverted L-shaped attaching member 12C attached on a rear end surface 4A of the carrier frame 4. An arm portion 12D of the attaching member 12C is fixed to the upper surface of the rear portion of the carrier frame 4.

The weight guides 13 and 14 are provided in the front-rear direction of the vehicle 2 and are used for attaching the counterweight 9 to the swiveling body 6. The weight guide 13 is used for positioning the counterweight 9 at the first attaching position P1 (FIG. 4). The weight guide 14 is used for positioning the counterweight 9 at the second attaching position P2 (FIG. 4).

That is, at least two attaching positions P1 and P2 are set for the swiveling body 6 (FIG. 3A) as positions at which the telescopic cylinders 16 (FIG. 2) are attached to be described later.

The weight guide 13 is provided on a front side of the weight support portion 11, and includes a guide portion 13A for guiding the attaching position of the counterweight 9 in the front-rear direction and a guide pin 13B for locking the counterweight 9 guided to the attaching position.

The weight guide 14 is provided on a rear side of the weight guide 13, has the same structure as the weight guide 13, and is set to have a height lower than the weight guide 13. That is, the weight guide 14 is provided between the weight support portions 11 and 12, and includes a guide portion 14A for guiding the attaching position of the counterweight 9 in the front-rear direction and a guide pin 14B for locking the counterweight 9 guided to the attaching position by the guide portion 14A.

(About Work of Attaching Counterweight 9 to Turning Body 6)

Next, a work of attaching the counterweight 9 to the swiveling body 6 will be described separately in a case where the counterweight 9 is positioned at the first attaching position P1 which is relatively the front side and a case where the counterweight 9 is positioned at the second attaching position P2 which is relatively the rear side.

(Case where Counterweight 9 is Positioned at First Mounting Position P1)

First, a case where the counterweight 9 is positioned at the first attaching position P1 will be described with reference to FIGS. 5, 6A, 6B, and 6C.

First, the boom 7 is set to face backward by swiveling the swiveling body 6 180° from the position shown in FIG. 1. The counterweight 9 placed on the ground or the like is lifted by the crane device 3, and the counterweight 9 is attached at the first attaching position P1 on the upper surface of the rear portion of the carrier frame 4 as shown in FIG. 5.

Figure 5:
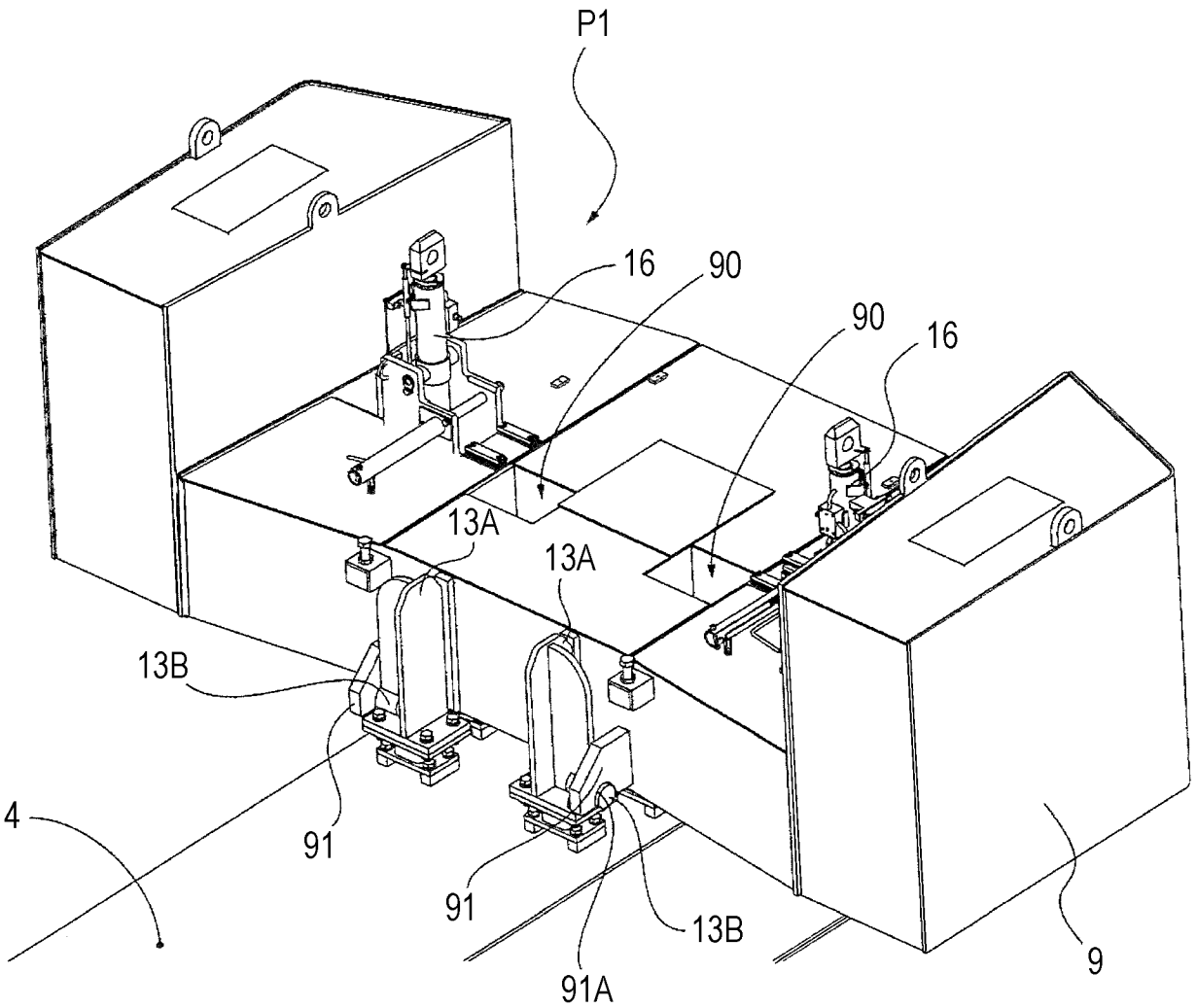
FIG. 5 is a perspective view showing the counterweight attached on an upper surface of a rear portion of a carrier frame.

At this time, as shown in FIG. 5, the counterweight 9 is lowered while a front surface of the counterweight 9 abuts on the guide portions 13A of the weight guides 13 from the rear. Accordingly, the counterweight 9 can be lowered in a state in which the front-rear direction of the counterweight 9 is positioned at the first attaching position P1. At the same time, when inner surfaces (facing surfaces facing each other) of the locking portions 91 move down while being guided by outer surfaces of the weight guides 13, left and right positions of the counterweight 9 can also be positioned. The guide pins 13B of the weight guides 13 are caught in the recesses 91A, and the counterweight 9 is locked to the weight guides 13.

At this time, as shown in FIG. 5, the weight guides 14 (FIG. 4) are inserted into the spaces 90 provided in the counterweight 9. The spaces 90 serve as escape ports such that the weight guides 14 do not disturb when the counterweight 9 is positioned at the first attaching position P1.

The position when the front surface of the counterweight 9 abuts on the weight guides 13 is set such that the rod passage 60A is disposed directly above the piston rod 16B of the telescopic cylinder 16.

As shown in FIG. 5, the counterweight 9 is attached to the weight support portions 11 (FIG. 4), and the guide pins 13B are locked into the recesses 91A of the locking portions 91.

Subsequently, in order to attach the counterweight 9 to the swiveling body 6, the swiveling body 6 is moved to the position shown in FIG. 1. Accordingly, the rear portion of the swiveling body 6 is disposed above the rear portion of the carrier frame 4 as shown in FIG. 6A.

Figure 6A:
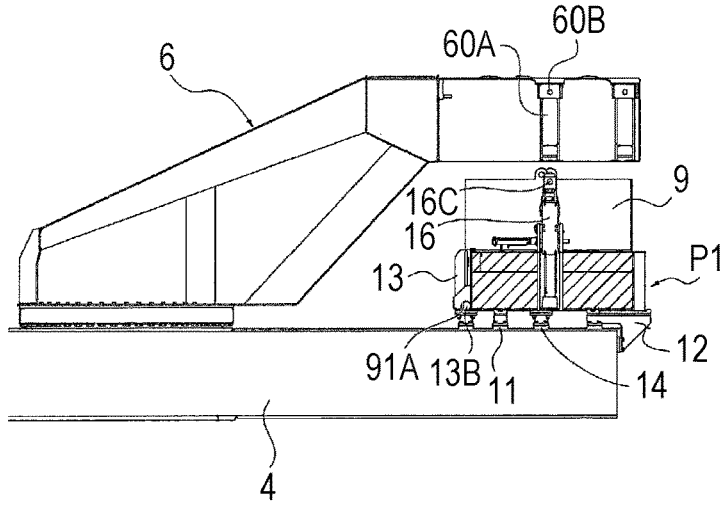
FIG. 6A is a side sectional view showing the counterweight attached on the upper surface of the rear portion of the carrier frame.

At this time, the rod passage 60A is disposed at a position directly above the piston rod 16B as shown in FIG. 6A.

The other end side of the hydraulic hose of which one end side is connected to the port of the telescopic cylinder 16 is connected to a hydraulic circuit (not shown) provided in the crane device 3.

Accordingly, the supply and discharge of a hydraulic oil from the hydraulic circuit are controlled, and an extension and contraction operation of the telescopic cylinder 16 is controlled.

Subsequently, the telescopic cylinder 16 is extended by using the supply and discharge of the hydraulic oil.

Figure 6B:
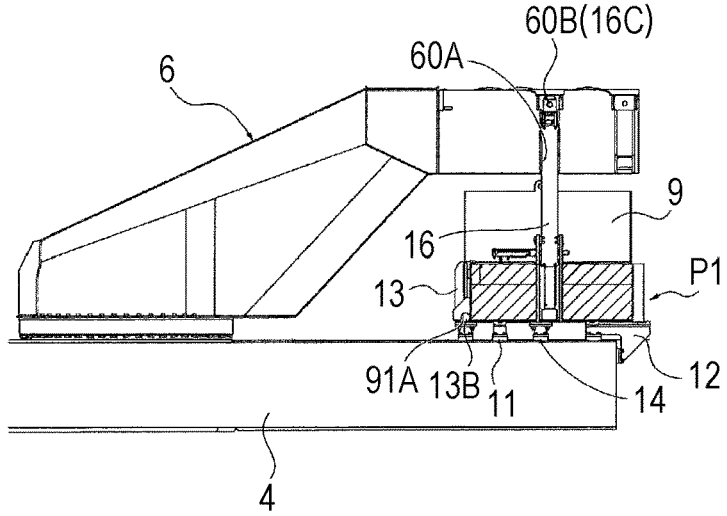
FIG. 6B is a side sectional view showing the counterweight in a state in which a telescopic cylinder is extended.
Figure 6C:
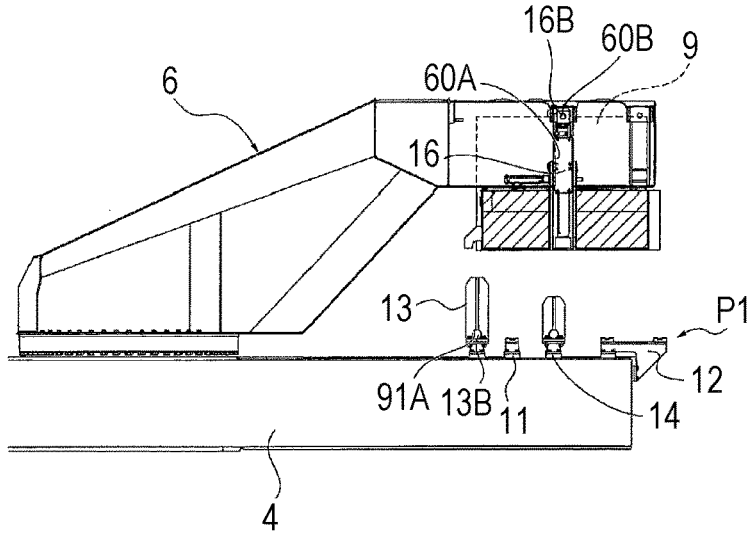
FIG. 6C is a side sectional view showing the counterweight in a state in which the telescopic cylinder is contracted.

When the telescopic cylinder 16 is extended, the piston rod 16B moves upward as shown in FIG. 6B.

As shown in FIG. 6B, when the piston rod 16B enters the rod passage 60A from below and the upper end portion of the piston rod 16B comes in contact with the ceiling plate of the rod passage 60A, the extension of the telescopic cylinder 16 is stopped.

When the piston rod 16B comes in contact with the ceiling plate of the rod passage 60A, the positions of the rod hole portion 16C and the swiveling body connection hole portion 60B are aligned as shown in FIG. 6B.

The connection pin is inserted into the rod hole portion 16C and the swiveling body connection hole portion 60B, and the piston rod 16B is connected to the swiveling body 6.

Subsequently, the telescopic cylinder 16 is contracted by using the supply and discharge of the hydraulic oil.

Figure 8A:
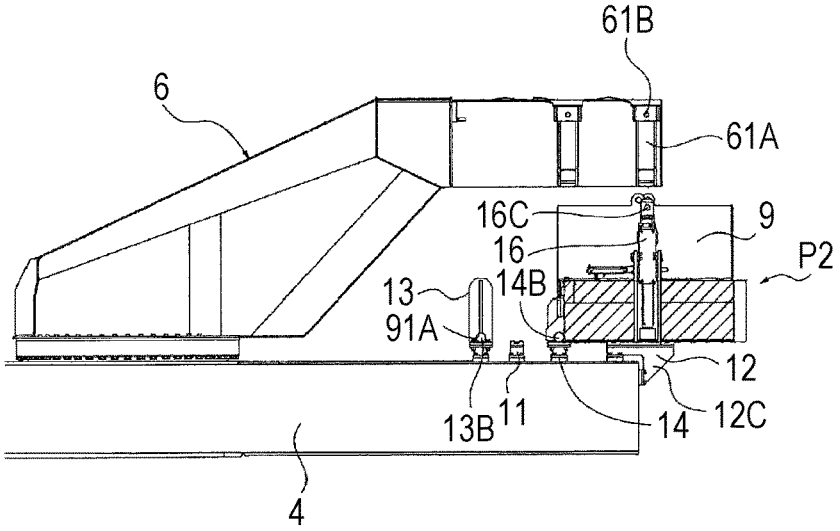
FIG. 8A is a side sectional view showing the counterweight attached on the upper surface of the rear portion of the carrier frame.
Figure 8B:
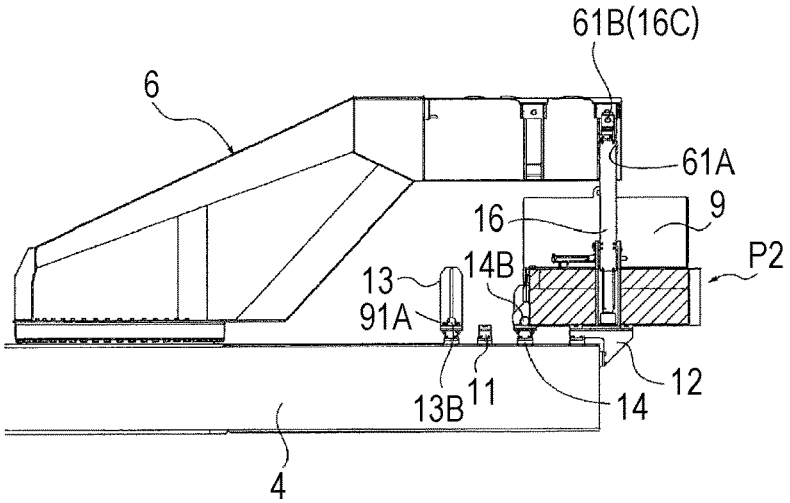
FIG. 8B is a side sectional view showing the counterweight in a state in which the telescopic cylinder is extended.
Figure 8C:
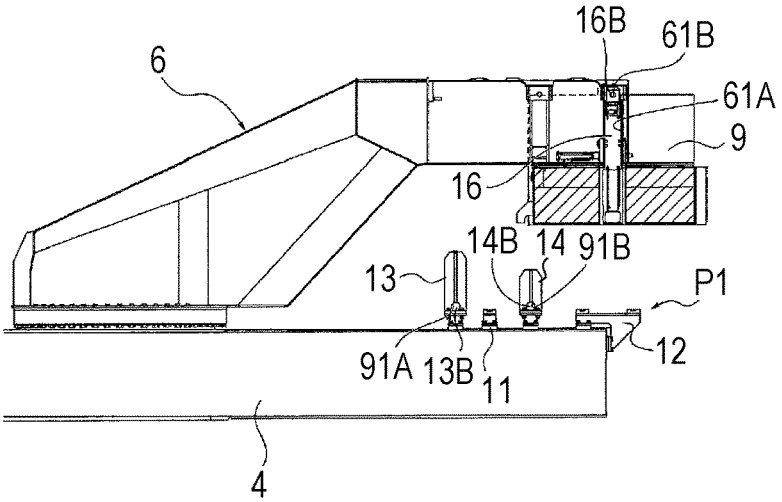
FIG. 8C is a side sectional view showing the counterweight in a state in which the telescopic cylinder is contracted.

Since the telescopic cylinder 16 is connected to the swiveling body 6, the tube 16A of the telescopic cylinder 16 moves upward due to the contraction of the telescopic cylinder 16 as shown in FIG. 8C.

Along with this movement, as shown in FIG. 8C, the counterweight 9 pivotally supported by the tube 16A rises with the tube 16A (FIG. 2).

When the counterweight 9 is raised until the upper surface of the rear portion of the counterweight 9 comes in contact with the lower surface of the swiveling body 6, the counterweight 9 is fixed to the swiveling body 6 by inserting fixing pins (not shown) into hole portions (not shown) respectively provided in the counterweight 9 and the swiveling body 6.

When the counterweight 9 is fixed to the swiveling body 6, the telescopic cylinder 16 is extended, and thus, a weight of the counterweight 9 is supported by the fixing pins.

As described above, the work of positioning the counterweight 9 at the first attaching position P1 and attaching the counterweight 9 on the swiveling body 6 is completed.

(Case where Counterweight 9 is Positioned at Second Mounting Position P2)

Subsequently, a case where the counterweight 9 is positioned at the second attaching position P2 will be described with reference to FIGS. 7, 8A, 8B, and 8C.

First, the boom 7 is set to face backward by swiveling the swiveling body 6 180° from the position shown in FIG. 1. The counterweight 9 placed on the ground or the like is lifted by the crane device 3, and the counterweight 9 is attached at the second attaching position P2 on the upper surface of the rear portion of the carrier frame 4.

Figure 7:
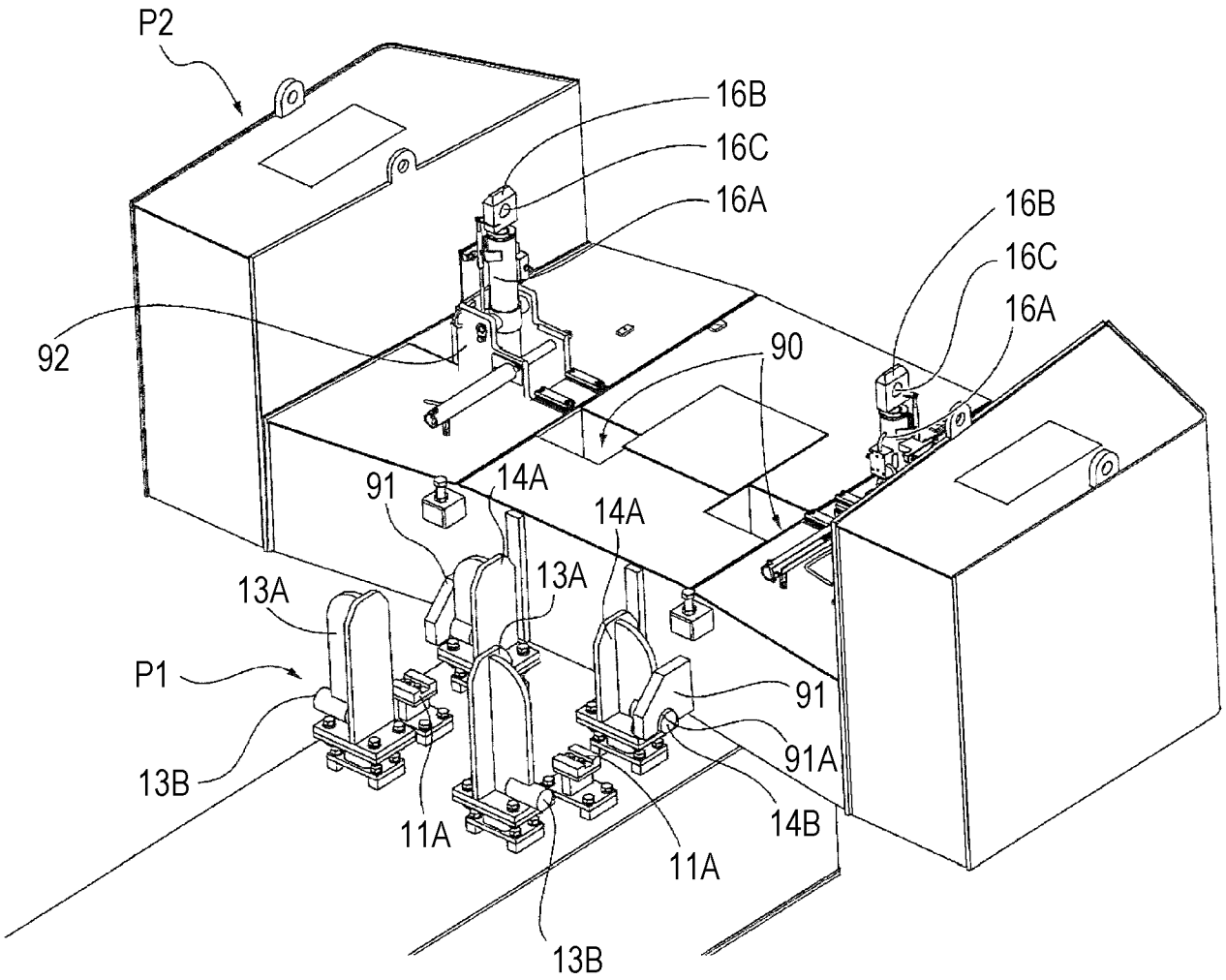
FIG. 7 is a perspective view showing the counterweight attached on the upper surface of the rear portion of the carrier frame.

At this time, as shown in FIG. 7, the counterweight 9 is lowered while the front surface of the counterweight 9 abuts on the guide portions 14A of the weight guides 14 from the rear. Accordingly, the counterweight 9 can be lowered in a state in which the front-rear direction of the counterweight 9 is positioned at the second attaching position P2. At the same time, when inner surfaces (facing surfaces facing each other) of the locking portion 91 move down while being guided by outer surfaces of the weight guides 14, the left and right positions of the counterweight 9 can also be positioned. The guide pins 14B of the weight guides 14 are caught in the recesses 91A, and the counterweight 9 is locked to the weight guides 14.

The position when the front surface of the counterweight 9 abuts on the weight guides 14 is set such that the rod passage 61A is disposed directly above the telescopic cylinder 16.

At this time, as shown in FIG. 8A, since a center of gravity of the counterweight 9 is supported by the attaching members 12C (FIG. 4) of the weight support portions 12, the counterweight 9 is prevented from falling behind the carrier frame 4.

As shown in FIG. 7, the counterweight 9 is attached to the weight support portions 11, and the guide pins 14B are locked into the recesses 91A of the locking portions 91.

Subsequently, in order to attach the counterweight 9 to the swiveling body 6, the swiveling body 6 is moved to the position shown in FIG. 1. Accordingly, as shown in FIG. 8A, the rear portion of the swiveling body 6 is disposed above the rear portion of the carrier frame 4.

At this time, the rod passage 61A is disposed at a position directly above the piston rod 16B as shown in FIG. 8A.

The other end side of the hydraulic hose of which one end side is connected to the port of the telescopic cylinder 16 is connected to a hydraulic circuit (not shown) provided in the crane device 3.

Accordingly, the supply and discharge of a hydraulic oil from the hydraulic circuit are controlled, and an extension and contraction operation of the telescopic cylinder 16 is controlled.

Subsequently, the telescopic cylinder 16 is extended by using the supply and discharge of the hydraulic oil.

When the telescopic cylinder 16 is extended, the piston rod 16B protrudes upward and moves upward as shown in FIG. 8B.

As shown in FIG. 8B, when the piston rod 16B enters the rod passage 61A from below and the upper end portion of the piston rod 16B abuts on the ceiling plate of the rod passage 61A, the extension of the telescopic cylinder 16 is stopped.

When the piston rod 16B comes into contact with the ceiling plate of the rod passage 61A, the positions of the rod hole portion 16C and the swiveling body connection hole portion 61B are aligned as shown in FIG. 8B.

The connection pin is inserted into the rod hole portion 16C and the swiveling body connection hole portion 61B, and the piston rod 16B is connected to the swiveling body 6.

Subsequently, the telescopic cylinder 16 is contracted by using the supply and discharge of the hydraulic oil.

Since the telescopic cylinder 16 is connected to the swiveling body 6, the tube 16A of the telescopic cylinder 16 moves upward due to the contraction of the telescopic cylinder 16 as shown in FIG. 8C.

Along with this movement, as shown in FIG. 8C, the counterweight 9 pivotally supported by the tube 16A rises with the tube 16A (FIG. 2).

When the counterweight 9 is raised until the upper surface of the rear portion of the counterweight 9 comes in contact with the lower surface of the swiveling body 6, the counterweight 9 is fixed to the swiveling body 6 by inserting fixing pins (not shown) into hole portions (not shown) respectively provided in the counterweight 9 and the swiveling body 6.

When the counterweight 9 is fixed to the swiveling body 6, the telescopic cylinder 16 is extended, and thus, a weight of the counterweight 9 is supported by the fixing pins.

As described above, the work of positioning the counterweight 9 at the second attaching position P2 and attaching the counterweight 9 on the swiveling body 6 is completed.

As described above, according to the aforementioned crane 1, the space saving and improvement of stability performance can be selected depending on an application without changing a total weight of a vehicle body. Specifically, when the attaching position of the counterweight 9 is set to the front side, since the counterweight 9 does not protrude toward the rear end side of the swiveling body 6, a radius of gyration of the rearmost end of the crane 1 can be reduced, and thus, the crane can be applied to a site having a limited work space. Accordingly, in recent years, the issue is how to improve stability performance within a range of limited performance while achieving a space-saving vehicle body in order to adopt the crane to various on-side works, and this issue is solved in the present embodiment. When the attaching position of the counterweight 9 is set to the rear side (in this case, the attaching position of the counterweight 9 is further separated from the pivot center and the counterweight 9 protrudes toward the rear end side of the swiveling body 6 in the present embodiment), the moment of the counterweight 9 can be increased without changing the total weight of the vehicle body, and thus, the stability performance can be improved. Since the cylinder device which is a attaching device is on the counterweight 9 side, the attaching position of the counterweight 9 can be freely set within an installable range of the swiveling body 6.

Although the embodiment of the present invention has been described in detail with reference to the drawings, the embodiment is merely an example of the present invention, and thus, the present invention is not limited to the configuration of the embodiment. Even though there is a design change or the like without departing from the gist, such a change is included in the present invention.

Figure 9:
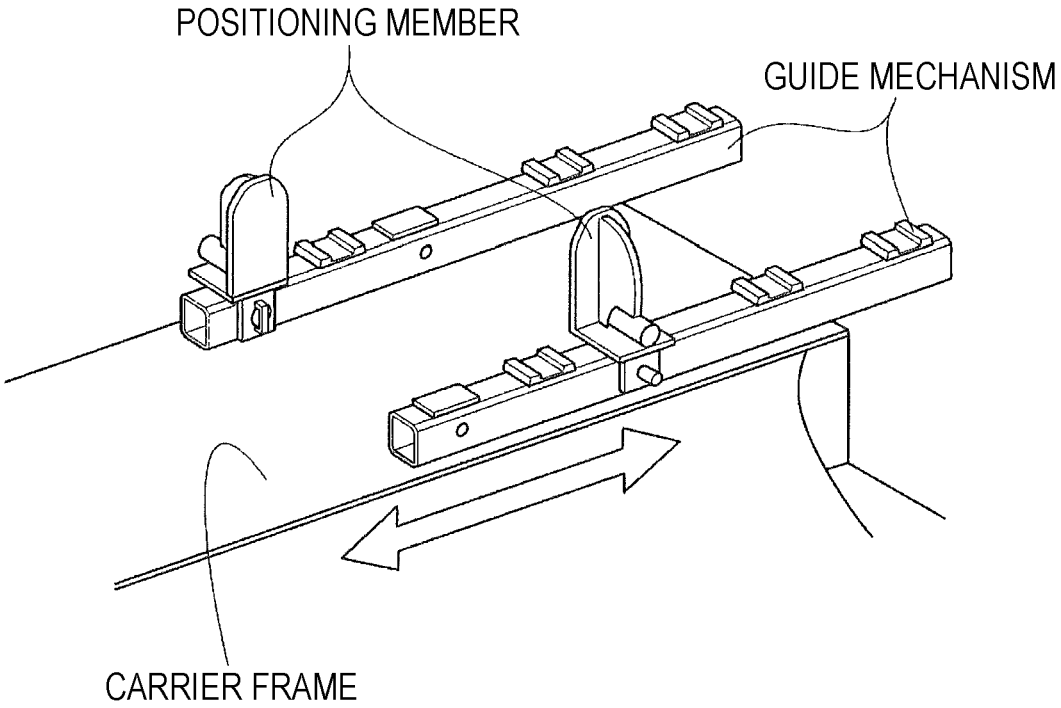
FIG. 9 is an explanatory diagram showing a modification example of the crane of the present invention.

For example, as shown in FIG. 9, the crane may include positioning members for positioning the counterweight and guide mechanisms for slidably guiding the positioning members in the front-rear direction (a direction of a white arrow indicated in the drawing). The guide mechanisms guide the positioning members from a rear end of the carrier frame until the guide mechanisms project integrally.

Although it has been described in the aforementioned embodiment that the number of cylinder connection units is two, in other words, the number of attaching positions of the counterweight is two locations, when the counterweight can be selectively attached and detached to and from any one of the attaching positions, the number of attaching positions of the counterweight may be three or more locations.

APPENDIX

According to the above embodiment, a first example of a crane includes a base, and a swiveling body that is provided above the base so as to swivel about a pivot center, and includes a boom and a counterweight attaching unit. The counterweight attaching unit includes a plurality of attaching positions, and is configured to selectively attach and detach a counterweight to and from any attaching position among the plurality of attaching positions, and the plurality of attaching positions is positions of which distances from the pivot center are different from each other.

According to the above embodiment, in a second example of the crane, in the first example, the counterweight attaching unit extends in a predetermined direction with respect to the pivot center, the plurality of attaching positions is positions different from each other in the predetermined direction, and the predetermined direction is a direction opposite to a direction in which the boom extends with respect to the pivot center when the swiveling body is viewed in plan view.

According to the above embodiment, in a third example of the crane, in the first example or the second example, the attaching position of which the distance is the longest among the plurality of attaching positions is a position at which a moment of the counterweight is maximized.

According to the above embodiment, in a fourth example of the crane, in any one of the first example to the third example, the attaching position of which the distance is the shortest among the plurality of attaching positions is a position at which a radius of gyration of a rear end of the swiveling body is minimized.

According to the above embodiment, in a fifth example of the crane, in any one of the first example to the fourth example, the attaching position of which the distance is the longest among the plurality of attaching positions is a position at which the counterweight protrudes in a direction separated from the pivot center than an end portion of the swiveling body, and the attaching position of which the distance is the shortest among the plurality of attaching positions is a position at which the counterweight does not protrude in the direction separated from the pivot center than the end portion of the swiveling body.

According to the above embodiment, in a sixth example of the crane, in any one of the first to fifth examples, the base includes a positioning unit that positions the counterweight before being attached to the counterweight attaching unit at a position of the counterweight attaching unit facing any attaching position.

According to the above embodiment, in a seventh example of the crane, in the sixth example, the positioning unit includes a plurality of positioning members arranged in a front-rear direction of the base, and the positioning member on a rear side is inserted in a space provided in the counterweight when the counterweight is attached to the positioning member on a front side.

According to the above embodiment, in the crane according to the sixth example or the seventh example, an eighth example of the crane further includes a guide mechanism that slidably guides the positioning unit in the front-rear direction.

The disclosure of Japanese Patent Application No. 2018-147697 filed on Aug. 6, 2018 including the specification, drawings and abstract is incorporated herein by reference in its entirety.

INDUSTRIAL APPLICABILITY

The crane of the present invention can be widely applied to a crane having a swiveling body on which a boom is attached.

REFERENCE SIGNS LIST

1 Crane
6 Turning body
7 Boom
9 Counterweight
13, 14 Weight guide (positioning member)
16 Telescopic cylinder (cylinder device)
90 Space
P1 First attaching position
P2 Second attaching position

The invention claimed is:

1. A crane comprising:

a vehicle comprising a carrier frame extending in a front-rear direction thereof; and a swiveling body that is provided above the carrier frame so as to swivel about a pivot center, and includes a boom and a counterweight attaching unit, wherein the counterweight attaching unit includes a plurality of attaching positions of which distances from the pivot center are different from each other, and is configured to selectively attach and detach a counterweight to and from any attaching position among the plurality of attaching positions, and the vehicle further comprises a supporting member provided to the carrier frame such that the supporting member projects rearward from a rear end of the carrier frame to support a center of gravity of the counterweight before attachment to a rear side attaching position of the plurality of attaching positions.

2. The crane according to claim 1, wherein the counterweight attaching unit extends in a predetermined direction with respect to the pivot center, the plurality of attaching positions is positions different from each other in the predetermined direction, and the predetermined direction is a direction opposite to a direction in which the boom extends with respect to the pivot center when the swiveling body is viewed in plan view.

3. The crane according to claim 1, wherein the attaching position of which the distance is the longest among the plurality of attaching positions is a position at which a moment of the counterweight is maximized.

4. The crane according to claim 1, wherein the attaching position of which the distance is the shortest among the plurality of attaching positions is a position at which a radius of gyration of a rear end of the swiveling body is minimized.

5. The crane according to claim 1, wherein the vehicle includes a positioning unit that positions the counterweight before being attached to the counterweight attaching unit at a position of the counterweight attaching unit facing any attaching position, and the positioning unit comprises: a guide having a surface configured to guide the counterweight to a predetermined position on the carrier frame; and a pin configured to lock the counterweight on the predetermined position.

6. The crane according to claim 5, wherein the positioning unit includes a plurality of positioning members arranged in the front-rear direction, and the positioning member on a rear side is inserted in a space provided in the counterweight when the counterweight is attached to the positioning member on a front side.

7. The crane according to claim 5, further comprising:

a guide mechanism that slidably guides the positioning unit in the front-rear direction.

* * * * *